US009532628B2

(12) United States Patent
Kaikou et al.

(10) Patent No.: US 9,532,628 B2
(45) Date of Patent: Jan. 3, 2017

(54) HOOK-AND-LOOP FASTENER MADE OF FABRIC

(71) Applicant: KURARAY FASTENING CO., LTD., Osaka-shi (JP)

(72) Inventors: Takayoshi Kaikou, Fukui (JP); Yukitoshi Higashinaka, Fukui (JP)

(73) Assignee: Kuraray Fastening Co., Ltd., Osaka-shi (JP)

( * ) Notice: Subject to any disclaimer, the term of this patent is extended or adjusted under 35 U.S.C. 154(b) by 0 days.

(21) Appl. No.: 14/914,168

(22) PCT Filed: Jan. 24, 2014

(86) PCT No.: PCT/JP2014/000370
§ 371 (c)(1),
(2) Date: Feb. 24, 2016

(87) PCT Pub. No.: WO2015/029274
PCT Pub. Date: Mar. 5, 2015

(65) Prior Publication Data

US 2016/0198810 A1 Jul. 14, 2016

(30) Foreign Application Priority Data

Aug. 27, 2013 (JP) ..... 2013-175361

(51) Int. Cl.
*A44B 18/00* (2006.01)

(52) U.S. Cl.
CPC ..... *A44B 18/0023* (2013.01); *A44B 18/0034* (2013.01); *A44B 18/0038* (2013.01); *A44B 18/0073* (2013.01); *D10B 2501/063* (2013.01)

(58) Field of Classification Search
CPC ..... A44B 18/0023; A44B 18/0038; A44B 18/0073; A44B 18/0034; A44B 18/0011; Y10T 428/24008; B32B 3/06
(Continued)

(56) References Cited

U.S. PATENT DOCUMENTS 4,654,246 A * 3/1987 Provost ..... A41F 1/00 26/2 R
5,231,738 A * 8/1993 Higashinaka ..... A44B 18/003 24/446
(Continued)

FOREIGN PATENT DOCUMENTS

JP 2002-223817 A 8/2002
JP 2002-238621 A 8/2002
(Continued)

OTHER PUBLICATIONS

International Search Report Issued Apr. 28, 2014 in PCT/JP14/00370 Filed Jan. 24, 2014.

*Primary Examiner* — Robert J Sandy
*Assistant Examiner* — Rowland Do
(74) *Attorney, Agent, or Firm* — Oblon, McClelland, Maier & Neustadt, L.L.P.

(57) ABSTRACT

A fabric surface fastener including a hook surface fastener (A) including hook-like engagement elements made of a monofilament yarn on a surface of a base fabric, and a loop surface fastener (B) including loop-like engagement elements made of a multifilament yarn on a surface of a base fabric, the loop-like engagement elements being engageable with the hook-like engagement elements. The monofilament yarn is a monofilament yarn made of polybutylene terephthalate polyester resin and having certain diameter. The multifilament yarn is a multifilament yarn made of polybutylene terephthalate polyester resin. A density of the hook-like engagement elements and a density of the loop-like engagement elements are in a certain range. The density of the hook-like engagement elements is higher than the density of the loop-like engagement elements. A ground warp yarn composing the base fabrics is a multifilament yarn made of polyethylene terephthalate polyester.

9 Claims, 1 Drawing Sheet

(58) Field of Classification Search
USPC ..... 24/445–448, 451, 452; 428/99, 100; 139/391; 28/161; 442/199, 200
See application file for complete search history.

(56) References Cited

U.S. PATENT DOCUMENTS

| | | | | |
|---|---|---|---|---|
| 6,642,160 | B1 * | 11/2003 | Takahashi ..... | A44B 18/0011 24/446 |
| 2006/0246256 | A1 * | 11/2006 | Ausen ..... | A44B 18/0011 428/100 |
| 2007/0036939 | A1 * | 2/2007 | Ferry (Hinton) .. | A44B 18/0061 428/100 |
| 2008/0289157 | A1 * | 11/2008 | Higashinaka ..... | A44B 18/0023 24/445 |
| 2014/0230123 | A1 * | 8/2014 | Kaikou ..... | A44B 18/003 2/69 |

FOREIGN PATENT DOCUMENTS

| | | | |
|---|---|---|---|
| JP | 2011-245045 | A | 12/2011 |
| WO | 2007/074791 | A1 | 7/2007 |
| WO | 2013/047098 | A1 | 4/2013 |

* cited by examiner

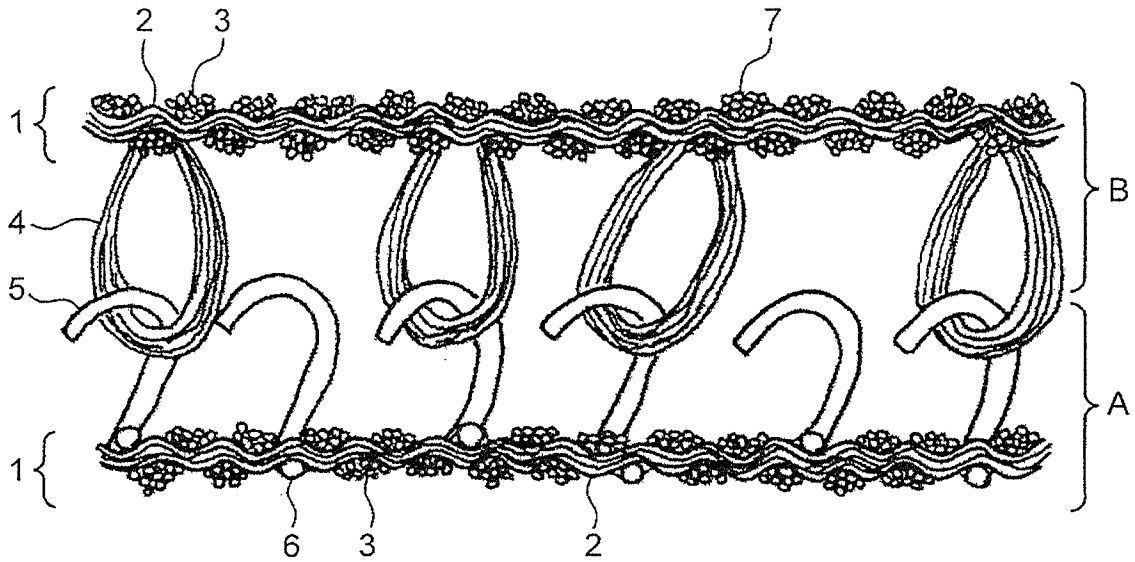
B
A
7
3
2
1
4
5
1
2
3
6

HOOK-AND-LOOP FASTENER MADE OF FABRIC

TECHNICAL FIELD

The present invention relates to a surface fastener consisting of a hook surface fastener made of a fabric and a loop surface fastener made of a fabric, in both of which engagement elements are made of polyester fibers, and more particularly to a surface fastener having a soft touch of engagement elements of both of a hook surface fastener and a loop surface fastener, and having a large engaging strength and excellent engagement durability.

BACKGROUND ART

Conventionally, there is widely known, as a surface fastener including a base fabric made of cloth, a fabric surface fastener consisting of a hook surface fastener (A) including hook-like engagement elements made of a monofilament yarn on a surface of a base fabric, and a loop surface fastener (B) including loop-like engagement elements made of a multifilament yarn on a surface of a base fabric, wherein the loop-like engagement elements are engageable with the hook-like engagement elements. The surface fasteners are packed in bags and sold in the market in a state that the hook surface fastener (A) and the loop surface fastener (B) are engaged with each other. The surface fasteners are widely used in many fields such as garments, shoes, caps/hats, belts, supporters, pillow covers, luggage/bags, blood pressure manometers, commodity goods, binding tapes, packing materials, materials for civil engineering and construction, materials for agricultural and fishing industries, and toys.

Generally, the hook surface fastener (A) and the loop surface fastener (B) are respectively manufactured by the following method. Specifically, in manufacturing a base fabric 1 consisting of a ground warp yarn 3 and a ground weft yarn 2, the hook surface fastener (A) is manufactured by weaving a monofilament yarn 6 for hook-like engagement elements 5 into a base fabric 1 in parallel to a ground warp yarn 3, locally forming loops of the monofilament yarn 6 on the base fabric 1, thermally fixing the loop shape, and cutting leg portions of loops to form hook-like engagement elements 5; and the loop surface fastener (B) is manufactured by weaving a multifilament yarn 7 for loop-like engagement elements 4 into a base fabric 1 in parallel to a ground weft yarn 2, and locally forming loops of the multifilament yarn 7 on the base fabric 1 to form loop-like engagement elements 4.

As described above, the hook surface fastener (A) or the loop surface fastener (B) is mainly consisting of a ground warp yarn, a ground weft yarn, and a monofilament yarn for hook-like engagement elements or a multifilament yarn for loop-like engagement elements. Conventionally, as the ground warp yarn, the ground weft yarn, the monofilament yarn for hook-like engagement elements, and the multifilament yarn for loop-like engagement elements, fibers made of polyamide polymer such as Nylon 6, Nylon 66, Nylon 610, or copolymer containing these compounds as a main component are generally used. When polyamide fibers are used, however, the base fabric may be deformed by water absorption, moisture absorption, or heat. In some cases, the base fabric may have a wavy appearance by moisture absorption, water absorption, or heat. Thus, the appearance of the base fabric may be impaired. As a result, the quality of a product attached with a surface fastener may be impaired or degraded. Further, an intended large engaging strength, which is a most important factor of a surface fastener, may not be obtained.

Nowadays, most of the garments are manufactured using polyester fibers. When a surface fastener to be attached to the garments is made of polyamide, it is extremely difficult to simultaneously dye the garments and the surface fastener with the same color in the same dyeing condition, because the dyeabilities of the garments and the surface fastener are completely different. In order to match the color tones between the garments and the surface fastener, it is necessary to prepare a stock of a large number of surface fasteners having the color tones of final products.

As a technique for eliminating the aforementioned drawbacks involved when polyamide fibers are used, in recent years, there is proposal to use fibers made of polyester polymer such as polyethylene terephthalate or polybutylene terephthalate having low water absorbency/moisture absorbency, or copolymer containing these compounds as a main component. There are some documents describing use of polyester fibers for a surface fastener.

For instance, Patent Literature 1 describes using, as engagement elements composing a surface fastener, and fibers composing a woven/knitted fabric including the engagement elements, it is possible to use synthetic fibers made of polyester polymer such as polyethylene terephthalate (hereinafter, abbreviated as PET), polybutylene terephthalate (hereinafter, abbreviated as PBT), or copolymer containing these compounds as a main component, in addition to synthetic fibers made of polyamide polymer such as Nylon 6, Nylon 66, or Nylon 610.

Further, Patent Literature 2 describes it is possible to use fibers made of polyesters such as PET or PBT as fibers composing a base fabric of a surface fastener in addition to fibers made of polyamides such as Nylon 6 or Nylon 66, and it is preferable to use a nylon or polyester monofilament yarn for hook-like engagement elements, and a nylon or polyester multifilament yarn for loop-like engagement elements.

It is true that use of PET polyester fibers for a hook surface fastener or for a loop surface fastener makes it possible to eliminate a drawback involved when polyamide fibers are used i.e. a drawback that a surface fastener has a wavy appearance by water absorption, moisture absorption, or heat; and a drawback that it is necessary to prepare a stock of a large number of surface fasteners of many color tones because the surface fasteners are made of the same polyester as the primary fibers composing modern garments and have a difference in dyeability with respect to the garments. On the other hand, when a monofilament yarn made of PET polyester is used for hook-like engagement elements of a hook surface fastener, loop-like engagement elements are likely to be cut because the hook-like engagement elements are too hard. Further, when an instantaneous load i.e. impact by repeated peeling is generated because of hardness of hook-like engagement elements, the hooks are extensively deformed, and it is difficult to restore the shape of the hook-like engagement elements. Further, when a multifilament yarn made of PET polyester is used as a yarn for loop-like engagement elements of a loop surface fastener, the multifilament yarn forming loops is not easily loosened, and loops are likely to be flattened by repeated peeling. Thus, the engaging strength and engagement durability may be lowered, and in sewing a surface fastener, when an engagement element falls by a sewing thread, the engagement element may not rise even after the sewing thread passes the portion where the engagement element falls. Further, since the engagement element is hard, the wearer may feel the surface fastener hard. Thus, the surface fastener may not be appropriate for articles such as garments and commodity goods in which a soft touch is required.

Further, when a multifilament yarn made of PBT polyester is used as a yarn for loop-like engagement elements of a loop surface fastener, if the loop density is high, a space for engagement may be narrowed because the multifilament yarn is likely to loosen. As a result, the loop-like engagement elements may interfere with each other, and it may be difficult for the loop-like engagement elements to engage with the hook-like engagement elements. Thus, it is necessary to secure a space for engagement by raising. Further, when a monofilament yarn made of PBT polyester is used for hook-like engagement elements of a hook surface fastener, even if the hook-like engagement elements are engaged with loops, the hook-like engagement elements may be extended and may be disengaged from the loops because the yarn is soft and has a low tensile strength.

An object of the invention is to eliminate the drawbacks of a surface fastener using polyamide fibers i.e. the surface fastener may be deformed by water absorption, moisture absorption, or heat, and it is necessary to prepare a stock of a large number of products of many colors, taking into consideration a difference in dyeability; and to eliminate the drawbacks of a surface fastener using PET fibers i.e. a hard touch by hard engagement elements, and lowering of the engaging strength and engagement durability because it is difficult to rise the fallen engagement elements, the hook-shape of hook-like engagement elements is likely to extend, loop-like engagement elements are likely to be cut and flattened, and loop-like engagement elements are not easily loosened. Another object of the invention is to eliminate a drawback involved when PBT fibers are used i.e. the engaging strength is low.

CITATION LIST

Patent Literature

Patent Literature 1: Japanese Unexamined Patent Publication No. 2002-238621 paragraph [0027]

Patent Literature 2: Japanese Unexamined Patent Publication No. 2002-223817 paragraph [0007] and paragraph [0008]

SUMMARY OF INVENTION

Specifically, an aspect of the present invention relates to a fabric surface fastener consisting of a hook surface fastener (A) including hook-like engagement elements made of a monofilament yarn on a surface of a base fabric, and a loop surface fastener (B) including loop-like engagement elements made of a multifilament yarn on a surface of a base fabric, the loop-like engagement elements being engageable with the hook-like engagement elements. The monofilament yarn is a monofilament yarn made of polybutylene terephthalate polyester resin and having a diameter of from 0.10 to 0.20 mm. The multifilament yarn is a multifilament yarn made of polybutylene terephthalate polyester resin. A density of the hook-like engagement elements is from 50 to 80 elements/cm$^2$, and a density of the loop-like engagement elements is from 30 to 50 elements/cm$^2$. The density of the hook-like engagement elements is higher than the density of the loop-like engagement elements. A ground warp yarn composing the base fabrics is a multifilament yarn made of polyethylene terephthalate polyester.

BRIEF DESCRIPTION OF THE VIEW OF THE DRAWING

FIG. 1 is an example embodiment of a hook surface fastener and a loop surface fastener.

DESCRIPTION OF EMBODIMENTS

In the following, an embodiment for carrying out the present invention will be described in details. The present invention, however, is not limited by the embodiment.

In the embodiment, a monofilament yarn composing hook-like engagement elements, and a multifilament yarn composing loop-like engagement elements are PBT polyester yarns.

Hook surface fasteners and loop surface fasteners have been manufactured by the same manufacturer, and are sold in the market as sets of surface fasteners. Hook-like engagement elements and loop-like engagement elements are made of the same resin. In the embodiment, same PBT polyester is used for hook-like engagement elements and for loop-like engagement elements. This is because articles to which a hook surface fastener and a loop surface fastener are attached are normally the same, and the hook surface fastener and the loop surface fastener are required to have the same dyeability.

A hook surface fastener (A) constituting the embodiment mainly consists of a monofilament yarn 6 for hook-like engagement elements 5, a ground warp yarn 3, and a ground weft yarn 2. On the other hand, a loop surface fastener (B) to be engaged with the hook surface fastener (A) mainly consists of a multifilament yarn 7 for loop-like engagement elements 4, a ground warp yarn 3, and a ground weft yarn 2.

Hook-like engagement elements composing the hook surface fastener (A) are required to have a softness, and hook shape retainability against repeated peeling. In view of the above, conventionally, a thick monofilament yarn made of synthetic resin is used. In the embodiment, as a monofilament yarn, a monofilament yarn made of PBT polyester having particularly excellent hook shape retainability against repeated peeling is used.

PBT polyester is polyester containing butylene terephthalate units as a main component, and is polyester mainly obtained by condensation reaction of terephthalic acid and 1,4-butandiol. Addition of a small amount of polymerizable units other than terephthalic acid and 1,4-butandiol may be allowed. Representative examples of the polymerizable units are aromatic dicarboxylic acids such as isophthalic acid, sulfoisophthalate sodium salt, phthalic acid, and naphthalene dicarboxylic acid; aliphatic or alicyclic dicarboxylic acids such as adipic acid, sebacic acid, and cyclohexane dicarboxylic acid; diols such as ethylene glycol and propylene glycol; oxycarboxylic acids such as hydroxybenzoic acid and lactic acid; and monocarboxylic acids exemplified by benzoic acid. Further, a small amount of polymer other than the aforementioned PBT polyester may be added.

The thickness of the monofilament yarn for hook-like engagement elements made of polyester as described above may be in the range of from 0.14 to 0.20 mm in diameter. When the thickness is smaller than 0.14 mm, a sufficient engaging strength may not be obtained. Even if the hook density is increased, it is necessary to increase the loop density because the strength per yarn is low. When the thickness exceeds 0.20 mm, it is difficult to weave a fabric unless the number of monofilament yarns to be woven into a base fabric is reduced. Even if it is possible to weave a fabric, the fabric has a thick and rough structure. This may make it difficult to obtain a soft touch.

The diameter is a diameter obtained by converting the sectional shape of a monofilament yarn into a solid circle. Therefore, the sectional shape may be a polygonal shape such as a triangular shape, a square shape, or a pentagonal shape, or may be a shape other than a polygonal shape such as a rectangular shape, an oval shape, or a hollow shape. The diameter of the monofilament yarn for hook-like engagement elements defined in the embodiment is slightly smaller than the thickness of a monofilament yarn for hook-like engagement elements used in a conventional general surface fastener. When the thickness is combined with the loop surface fastener (B) to be described later, a large engaging strength and a soft touch are obtained. The diameter of the monofilament yarn is preferably from 0.15 to 0.19 mm, and more preferably from 0.17 to 0.185 mm.

In the embodiment, loop-like engagement elements composing the loop surface fastener (B) consist of a multifilament yarn made of PBT polyester, as well as hook-like engagement elements.

It is preferable to use a multifilament yarn of 4 to 15 filaments and having a total decitex of 160 to 300 decitex, as the multifilament yarn for loop-like engagement elements composed of PBT polyester. It is preferable to decrease the number of filaments composing loop-like engagement elements in order to firmly fix the loop-like engagement elements to a base fabric by thermal adhesion in infiltrating molten resin. The number of filaments of the multifilament yarn for loop-like engagement elements constituting the embodiment is preferably slightly smaller than the number of filaments of the conventionally and generally used multifilament yarn composing loop-like engagement elements. The multifilament yarn is a multifilament yarn of preferably 4 to 12 filaments, and more preferably 6 to 10 filaments, and having a total decitex of 200 to 260 decitex. In the embodiment, the multifilament yarn composing loop-like engagement elements may include a small amount of other filament yarns, in addition to the multifilament yarn made of PBT polyester.

In the embodiment, preferably, the height of a hook-like engagement element of the hook surface fastener (A) is in the range of from 1.3 to 2.5 mm from the surface of the base fabric, and the height of a loop-like engagement element of the loop surface fastener (B) is in the range of from 1.8 to 3.0 mm from the surface of the base fabric.

In the embodiment, preferably, the density of hook-like engagement elements of the hook surface fastener (A) is in the range of from 50 to 80 elements/cm$^2$. When the density is smaller than 50 elements/cm$^2$, a large engaging strength is not obtained. When the density exceeds 80 elements/cm$^2$, hook-like engagement elements may interfere with each other, which may obstruct engagement with loop-like engagement elements. In view of the above, preferably, the density of hook-like engagement elements of the hook surface fastener (A) is in the range of from 55 to 75 elements/cm$^2$.

It is necessary to secure the range of from 30 to 50 elements/cm$^2$ (multifilament units) as the density of loop-like engagement elements of the loop surface fastener (B). When the density exceeds 50 elements/cm$^2$, loop-like engagement elements may interfere with each other, and it may be impossible to obtain a large engaging strength. When the density is smaller than 30 elements/cm$^2$, the degree of engagement may be small, and a large engaging strength is not obtained. In view of the above, preferably, the density of loop-like engagement elements of the loop surface fastener (B) is in the range of from 35 to 45 elements/cm$^2$.

Loop-like engagement elements of the loop surface fastener constituting the embodiment consist of a PBT multifilament yarn. Loop-like engagement elements composed of a PBT multifilament yarn are such that filament fibers are easily loosened. Therefore, the loop-like engagement elements are easily engaged with hook-like engagement elements, as compared with loop-like engagement elements made of PET. This makes it possible to obtain a large engaging strength.

Further, in the embodiment, setting the density of hook-like engagement elements higher than the density of loop-like engagement elements is an important requirement in the embodiment because when the density of hook-like engagement element is higher than the density of loop-like engagement elements, one loop-like engagement element is likely to engage with two or more hook-like engagement elements, the engagement is stabilized, and as a result, a large engaging strength and excellent engagement durability are obtained. The density of hook-like engagement elements is higher than the density of loop-like engagement elements preferably by 5 elements/cm$^2$ or more, more preferably by 10 elements/cm$^2$ or more. It is preferable to uniformly distribute the hook-like engagement elements and the loop-like engagement elements on the surface of a base fabric.

In the embodiment, preferably, the monofilament yarn composing hook-like engagement elements of the hook surface fastener (A) and the multifilament yarn composing loop-like engagement elements of the loop surface fastener (B) are woven into a base fabric in parallel to a ground warp yarn. In the case of the yarn for hook-like engagement elements, the yarn locally crosses over the ground warp yarn, and forms loops at a position where the yarn crosses over the ground warp yarn so that hooks are inclined in a certain direction with respect to the ground warp yarn direction. In the case of the yarn for loop-like engagement elements, the yarn forms loops substantially in parallel to the ground warp yarn without crossing over the ground warp yarn. This is preferable because the loop-like engagement elements are easily engaged with the hook-like engagement elements, and a large engaging strength is obtained.

In the process of manufacturing a surface fastener by combining the hook surface fastener (A) and the loop surface fastener (B) of the embodiment, heat is applied to the fabric for a hook surface fastener and to the fabric for a loop surface fastener in order to fix the hook shape of hook-like engagement elements and the loop shape of loop-like engagement elements. In the surface fastener of the embodiment, heat to be applied for fixing the hook shape and the loop shape simultaneously adheres the thermal adhesive fibers composing the base fabric, and the loop-like engagement elements and the hook-like engagement elements are fixed to the base fabric. In view of the above, the temperature of heat to be applied is generally from 150 to 210° C., which is a temperature at which the monofilament yarn for hook-like engagement elements and the multifilament yarn for loop-like engagement elements are thermally fixed. Preferably, the temperature is from 160 to 200° C., and more preferably from 170 to 200° C.

In the hook surface fastener (A), leg portions of loops for hook-like engagement elements are cut into hook-like engagement elements. Preferably, a cutting device for use in cutting leg portions of loops for hook-like engagement elements for forming hook-like engagement elements has a configuration such that leg portions of loops for hook-like engagement elements for a fabric for a hook surface fastener are cut by reciprocating movement of a movable cutting blade, which travels in the ground warp yarn direction in a region between two fixed blades. In view of the above, preferably, loops for hook-like engagement elements are formed at a position where the yarn crosses over the ground warp yarn as described above in order to easily cut only leg portions of the loops.

It is preferable to use a polyester multifilament yarn as a ground warp yarn composing a base fabric for a surface fastener consisting of the hook surface fastener (A) and the loop surface fastener (B) of the embodiment.

Specifically, an example of the polyester multifilament yarn is a PET multifilament yarn having an excellent heat resistance. In particular, a multifilament yarn made of PET polyester is used for the hook surface fastener (A) and for the loop surface fastener (B) in terms of size stability. This is because when a multifilament yarn made of PBT polyester is used, although an excellent softness is obtained, size stability may be deteriorated. This may cause a drawback when a product is manufactured and used.

It is needless to say that PET resin composing a ground warp yarn may contain a small amount of copolymer component, other polymers, or other filaments. However, taking into consideration that a ground warp yarn is a yarn which directly affects stability in the manufacturing process, it is more preferable to use a multifilament yarn made of PET homopolymer having most excellent stability.

Regarding the thickness of the multifilament yarn composing a ground warp yarn, it is preferable to use a multifilament yarn of 16 to 96 filaments and having a total decitex of 75 to 250 decitex, and particularly preferable to use a multifilament yarn of 24 to 48 filaments and having a total decitex of 100 to 200 decitex. A base fabric is formed so that a multifilament yarn has a weaving density of 45 to 90 yarns/cm after heat treatment.

As described above, a monofilament yarn composing hook-like engagement elements, and a multifilament yarn composing loop-like engagement elements are woven into a base fabric in parallel to a ground warp yarn. Preferably, each of the number of monofilament yarns for hook-like engagement elements, and the number of multifilament yarns for loop-like engagement elements to be woven is in the range of about 3 to 8 with respect to 20 ground warp yarns (including the monofilament yarns for hook-like engagement elements and the multifilament yarns for loop-like engagement elements) after heat treatment.

As a material for the ground weft yarn to be used in the base fabric of the surface fastener of the embodiment, it is preferable to use polyester resin capable of firmly fixing the root of a monofilament yarn for hook-like engagement elements and the root of a multifilament yarn for loop-like engagement elements to the base fabric by thermal adhesion in the aforementioned heat treatment condition. For instance, it is preferable to use polyester fibers having a core-sheath structure in section, in which a core component is not melted but a sheath component is melted in a heat treatment condition.

Specifically, a representative example of polyester fibers is core-sheath type polyester fibers, in which a core component is PET, and a sheath component is PET copolymer obtained by copolymerizing a large amount of e.g. 20 to 30 mol % of copolymerizable component as exemplified by isophthalic acid or adipic acid. It is preferable to set the melting point or the softening point of the sheath component from 100 to 200° C., and it is preferable to set the melting point of the sheath component lower than the melting point of the ground warp yarn, the monofilament yarn for hook-like engagement elements, or the multifilament yarn for loop-like engagement elements by 20 to 100° C.

More preferably, the ground weft yarn is a multifilament yarn made of core-sheath type composite fibers in which the sheath component is PBT polyester.

In the embodiment, preferably, the sheath component contains fine particles of 0.03 to 1% by weight.

The fine particles may be inorganic fine particles or may be organic fine particles. Preferably, it is desirable to use inorganic fine particles having a property that the fine particles are stable when heat is applied.

As the organic fine particles, any organic fine particles capable of preventing excessive flow of a sheath component may be used, far as the organic fine particles contain a component having a melting point higher than the melting point of the sheath component by 5° C. or more.

Examples of the organic fine particles are fine particles of polyphenylene sulfide (PPS) resin (melting point: about 280° C.), polyethylene terephthalate (PET) resin (melting point: about 260° C.), polybutylene terephthalate (PBT) resin (melting point: about 225° C.), and polyether etherketone (PEEK) resin (melting point: about 340° C.).

Examples of the inorganic fine particles are titanium oxide, zinc oxide, silicon oxide, and barium sulfate. Among these, titanium oxide is preferably used.

Adding inorganic fine particles of the predetermined amount as described above makes it possible to widely spread a molten binder resin and to widely infiltrate the molten binder resin in the base fabric when a sheath component is melted and functioned as a binder. Thus, it is possible to prevent hardening of the base fabric.

When the added amount of inorganic fine particles is smaller than 0.03% by weight, it may be impossible to sufficiently prevent flow of resin. When the added amount of inorganic fine particles exceeds 1% by weight, the ability of fixing the root of the monofilament yarn for hook-like engagement elements and the root of the multifilament yarn for loop-like engagement elements by the molten resin may be lowered, and engagement elements are likely to be pulled out by repeated engagement and peeling.

More preferably, it is desirable to add inorganic fine particles of 0.04 to 0.8% by weight.

In order to suppress shiny appearance of synthetic fibers for garments, generally, titanium oxide is added to resin composing the synthetic fibers. Even in the case of core-sheath type thermal adhesive fibers, generally, titanium oxide is added when the core-sheath type thermal adhesive fibers are used for garments.

In the aforementioned case, titanium oxide is added to resin serving as a core component, which remains in the garments while keeping the fiber configuration after thermal adhesion. Generally, titanium oxide is not added to a sheath component that is melted.

The inventors of the present application found that adding inorganic fine particles to a sheath component, to which inorganic fine particles are not generally added in the conventional art, makes it possible to prevent flow and infiltration of molten sheath component resin into the base fabric, and achieved the preferred embodiment of the invention.

It is desirable for the sheath component resin of core-sheath type thermal adhesive fibers serving as a ground weft yarn to have a melting point or a softening point lower than the melting point or the softening point of the monofilament yarn for hook-like engagement elements, the multifilament yarn for loop-like engagement elements, the ground warp yarn, and the core component resin of the core-sheath type thermal adhesive fibers. The sheath component resin is a resin whose melting point or softening point is lower than the melting point or the softening point of these materials preferably by 20° C. or more, more preferably by 30° C. or more.

Specifically, the sheath component resin is a resin whose melting point or softening point is from 150 to 200° C. Examples of the sheath component resin are PBT polyester resin obtained by copolymerizing isophthalic acid, sulfoisophthalate sodium salt, ethylene glycol, or propylene glycol.

As the core component, it is preferable to use polyester resin in terms of peeling resistance against the sheath component resin, and in terms of matching dyeability. Examples of the core component are PET homopolymer or PBT homopolymer in view of the requirement that the resin should have a high melting point. Among these, PET homopolymer is particularly preferable in terms of shape stability.

As a ratio of thermal adhesive fibers with respect to fibers composing a ground weft yarn, it is preferable to form substantially all the ground weft yarns of core-sheath type thermal adhesive fibers in order to firmly fix the hook-like engagement elements and the loop-like engagement elements to the base fabric. Further, when the fibers are not composite fibers consisting of a core component and a sheath component, but are single fibers in which all the fibers are made of thermal adhesive polymer, the thermal adhesive polymer that is melt and cured is brittle and is likely to crack. When such a hard surface fastener is sewn, the base fabric is likely to be torn from the sewn portion. In view of the above, preferably, the thermal adhesive fibers contain thermal non-adhesive resin, and have a core-sheath structure in section. The weight ratio between the core component and the sheath component is preferably in the range of from 60:40 to 80:20. The core-sheath structure is not necessarily a completely concentric core-sheath structure. The core-sheath structure may be an eccentric core-sheath structure approximate to a bimetal shape.

In order to firmly fix the hook-like engagement elements and the loop-like engagement elements to the base fabric, it is preferable to thermally adhere the thermal adhesive fibers used as the ground well yarn, and to fasten the roots of the hook-like engagement elements and the loop-like engagement elements by shrinkage of the fibers from both sides thereof. For this purpose, the thermal adhesive fibers to be used as the ground weft yarn are preferably fibers in which a large heat shrinkage occurs in a heat treatment condition. Specifically, it is suitable to use fibers whose dry heat shrinkage rate is 12% or more at 200° C. More preferably, the fibers are fibers whose dry heat shrinkage rate at 200° C. is from 14 to 20%.

Regarding the thickness of the multifilament yarn composing a ground weft yarn, it is preferable to use a multifilament yarn of 24 to 72 filaments and having a total decitex of 75 to 300 decitex, and particularly preferable to use a multifilament yarn of 24 to 48 filaments and having a total decitex of 75 to 200 decitex. It is preferable to weave the multifilament yarn into a base fabric so that the weaving density after heat treatment is from 15 to 30 yarns/cm. It is preferable to set the weight ratio of the ground weft yarn in the range of from 15 to 40% with respect to the total weight of the monofilament yarn for hook-like engagement elements or the multifilament yarn for loop-like engagement elements, the ground warp yarn, and the ground weft yarn composing a surface fastener.

As described above, the embodiment is suitable for a surface fastener, in which an adhesive (so-called back-coat resin) is not coated on the back surface of a base fabric as in the conventional art by thermally adhering fibers composing a base fabric. It is needless to say that the embodiment is applicable to a surface fastener, in which an adhesive is coated on the back surface of a base fabric. In this case, a ground well yarn composing a base fabric is not required to have thermal adhesiveness. Further, a ground warp yarn and a ground well yarn composing a base fabric are not required to be polyester yarns. Preferably, however, in terms of dyeability, a ground warp yarn and a ground well yarn composing a base fabric are polyester yarns, and the ground well yarn composing the base fabric is made of thermal adhesive binder fibers.

As a weaving structure of a base fabric, a plain fabric in which a monofilament yarn for hook-like engagement elements and a multifilament yarn for loop-like engagement elements are a part of a ground warp yarn is preferable. The yarns for engagement elements are preferably such that the yarns exist in parallel to the ground warp yarn, and rise from the surface of the base fabric in the course of weaving the structure. In the case of the hook surface fastener (A), the weaving structure is such that the yarn skips 1 to 3 ground warp yarn while forming a loop, and sinks between the ground warp yarns. In the case of the loop surface fastener (B), the weaving structure in which the yarn exists in parallel to the ground warp yarn without crossing over the ground warp yarn is such that leg portions of loops for hook-like engagement elements are easily cut, and hook-like engagement elements and loop-like engagement elements are easily engaged with each other.

A fabric surface fastener consisting of the hook surface fastener (A) and the loop surface fastener (B) of the embodiment is usable in many fields in which the conventional surface fasteners are used, such as garments, shoes, bags, caps/hats, gloves, blood pressure manometers, supporters, binding bands for packing, binding tapes, toys, fixing of sheets for civil engineering and construction, fixing of various panels and wall materials, fixing of solar cells to roofs, fixing of electrical components, storage boxes and packing cases capable of assembling/disassembling, accessories, attachments for curtains. In particular, the fabric surface fastener is suitable for garments, shoes, gloves, caps/hats, and bags, in which softness and size stability are required.

When the fabric surface fastener of the embodiment is entirely composed of polyester fibers, it is possible to uniformly dye the fastener without causing color unevenness. In particular, when garments are made of polyester fibers, it is possible to simultaneously dye the garments and a surface fastener in the same dyeing condition. This eliminates the need of preparing a stock of a large number of surface fasteners of many colors for matching the colors to be dyed, unlike the conventional art. Thus, the fabric surface fastener is advantageously used.

Further, making a difference in color density by utilizing a difference in hardness and a difference in dyeability due to a difference in melting point between an engagement element portion and a base fabric portion makes it easy to discriminate the engagement element surface (front surface) and the base fabric surface (back surface) from each other. This makes it possible to avoid a sewing mistake in sewing the front surface and the back surface as small pieces.

The present specification discloses various aspects of technology as described above, the primary technology of which is summarized below.

A fabric surface fastener according to an aspect of the present invention is a fabric surface fastener consisting of a hook surface fastener (A) including hook-like engagement elements made of a monofilament yarn on a surface of a base fabric, and a loop surface fastener (B) including loop-like engagement elements made of a multifilament yarn on a surface of a base fabric, the loop-like engagement elements being engageable with the hook-like engagement elements, wherein the monofilament yarn is a monofilament yarn made of polybutylene terephthalate polyester resin and having a diameter of from 0.14 to 0.20 mm, the multifilament yarn is a multifilament yarn made of polybutylene terephthalate polyester resin, a density of the hook-like engagement elements is from 50 to 80 elements/$cm^2$, and a density of the loop-like engagement elements is from 30 to 50 elements/$cm^2$, the density of the hook-like engagement elements being higher than the density of the loop-like engagement elements, and a ground warp yarn composing the base fabrics is a multifilament yarn made of polyethylene terephthalate polyester.

The fabric surface fastener of the invention is such that the multifilament yarn composing the loop-like engagement elements of the loop surface fastener (B) is made of PBT polyester, and the density of the loop-like engagement elements is low. Therefore, the loop-like engagement elements are easily loosened and are less likely to be flattened. Thus, the loop-like engagement elements are easily engageable with the hook-like engagement elements of the hook surface fastener (A), and retain a large engaging strength. Further, the monofilament yarn composing the hook-like engagement elements of the hook surface fastener (A) is made of soft PBT polyester, is thin, and provides a high density of hook-like engagement elements. Therefore, it is possible to provide a soft touch, and to retain the hook shape for a long time without cutting a loop yarn. Further, the engagement elements easily rise even if they fall, and many loop fibers easily enter the hooks. Therefore, it is possible to obtain a large engaging strength and excellent engagement durability. Further, since the density of the loop-like engagement elements is lower than the density of the hook-like engagement elements, it is possible to further enhance the engaging strength. Furthermore, unlike a surface fastener using polyamide fibers, the fabric surface fastener is free of the drawbacks that the fastener may be deformed by water absorption, moisture absorption, or heat, and that it is necessary to prepare a stock of a large number of fasteners of many colors, taking into consideration a difference in dyeability with respect to garments composing fibers.

Conventionally, the following techniques are generally performed in order to enhance the engaging strength and engagement durability of a surface fastener. The monofilament yarn composing the hook-like engagement elements of the hook surface fastener is made thick so that the hook is not easily opened. The density of the hook-like engagement elements is reduced, in other words, the interval between the hook-like engagement elements is increased so that fibers composing the loop-like engagement elements easily enter the hooks of the hook-like engagement elements. Further, the density of the loop-like engagement elements of the loop surface fastener is increased so that a large amount of fibers composing the loop-like engagement elements enter the hooks of the hook-like engagement elements.

However, even if the aforementioned measures for enhancing the engaging strength and engagement durability is applied to the surface fastener having engagement elements made of PBT polyester, intended effects cannot be obtained. The inventors found that the drawbacks on the engaging strength and engagement durability cannot be eliminated by the aforementioned common sense when a hook surface fastener including hook-like engagement elements consisting of a monofilament yarn made of PBT polyester, and a surface fastener including loop-like engagement elements consisting of a multifilament yarn made of PBT polyester are combined. Specifically, the inventors found that the configuration in which the thickness of a monofilament yarn composing hook-like engagement elements of a hook surface fastener is reduced, the density of hook-like engagement elements is increased, and the density of loop-like engagement elements is reduced, which is completely contradictory to the conventional common sense, is advantageous in enhancing the engaging strength of a surface fastener and in enhancing the engagement durability. Concurrently, the inventors found that a surface fastener including engagement elements made of PBT fibers is advantageous in terms of softness and touch, and is less likely to be flattened, as compared with a surface fastener including engagement elements made of PET fibers.

Further, in the fabric surface fastener, forming the ground warp yarn of a multifilament yarn made of polyethylene terephthalate polyester is advantageous in securing shape stability.

Further, in the invention, the fibers composing the surface fastener are substantially polyester fibers in its entirety. Therefore, it is possible to dye the articles by the same dyeing process when the articles are dyed. When PET fibers are used for a base fabric portion, however, it is possible to discriminate the articles by the difference in color density by utilizing a difference in dyeability between an engagement element portion made of PBT, and the base fabric portion made of PET. This makes it easy to discriminate the front surface and the back surface of a surface fastener from each other when they are sewn as small pieces. This makes it possible to avoid a sewing mistake, which is likely to occur in the conventional art.

In the fabric surface fastener, preferably, a ground warp yarn and a ground weft yarn composing the base fabric of the hook surface fastener (A) and the base fabric of the loop surface fastener (B) may be made of polyester resin. The ground weft yarn may include core-sheath type thermal adhesive fibers. The hook-like engagement elements and the loop-like engagement elements may be adhesively fixed by the ground weft yarn composing the base fabric.

As described above, the ground weft yarn and the ground warp yarn composing the base fabric are composed of polyester fibers. Therefore, melting the ground weft yarn makes it possible to firmly adhere the hook-like engagement elements and the loop-like engagement elements to the base fabric, because the hook-like engagement elements and the loop-like engagement elements are composed of polyester fibers. This makes it possible to keep the engagement elements from being pulled out of the base fabric by repeated engagement and peeling. This is advantageous in obtaining an enhanced engaging strength and durability for a long time.

In the conventional surface fastener, an adhesive (so-called backcoat resin) is coated on the back surface of a base fabric so that the yarn for engagement elements is fixed to the base fabric and a resistance against pulling of engagement elements is obtained in order to keep the hook-like engagement elements and the loop-like engagement elements from being pulled out of the base fabric by a tensile strength exerted by engagement and peeling. However, when an adhesive is coated on the back surface of the base fabric, the base fabric is hardened because the base fabric is fixed by the adhesive. This is not appropriate in the field of garments in which softness is required. Contrary to the above, when polyester fibers are used, and thermal adhesive polyester fibers are used as a ground weft yarn as in the invention, it is possible to eliminate the aforementioned drawback by coating backcoat resin.

When polyamide fibers are used, it is not possible to obtain a commercially valuable surface fastener by thermal adhesion, because the fibers may be deteriorated or coloration may occur by application of heat. The invention can eliminate the aforementioned drawback.

In the fabric surface fastener, the ground weft yarn composing the base fabric is a multifilament yarn consisting of core-sheath type thermal adhesive fibers in which a sheath component is low melting point polyester of PET or PBT, and fine particles (specifically, inorganic fine particles) are contained in the sheath component of the thermal adhesive filaments. This makes it possible to suppress flow of a binder component (specifically, sheath component resin) after the sheath component of thermal adhesive filaments is melted and functioned as a binder. This makes it possible to reduce a likelihood that a molten resin such as a binder resin in which fine particles are not contained as described in the conventional art may flow into the base fabric and the base fabric may be hardened by the binder resin. Thus, the base fabric is advantageously soft.

Preferably, the low melting point polyester is PBT polyester. Since engagement elements made of PBT resin are soft, it is possible to obtain synergistic effects that the base fabric has an excellent softness. In particular, since all the fibers except for the ground warp yarn are made of PBT polyester, melting the ground weft yarn makes it possible to firmly adhere the hook-like engagement elements and the loop-like engagement elements to the base fabric. This makes it possible to keep the engagement elements from being pulled out of the base fabric by repeated engagement and peeling. This is advantageous in obtaining an enhanced engaging strength and durability for a long time.

Further, in the invention, the monofilament yarn composing the hook-like engagement elements, and the multifilament yarn composing the loop-like engagement elements are made of PBT polyester. A sheath component of the ground weft yarn for use in fixing the hook-like engagement elements and the loop-like engagement elements to the base fabric, in other words, a binder resin is also a PBT resin. This makes it possible to firmly fix the engagement elements to the base fabric. Further, inorganic fine particles are contained in the PBT polyester, which is a sheath component of core-sheath type binder fibers. This makes it possible to prevent the binder resin from melting and widely flowing into the base fabric, in other words, to prevent hardening of the base fabric by infiltration of the binder resin. Further, as described above, the ground warp yarn composing the base fabric is made of PET polyester. This makes it possible to obtain excellent size stability.

Thus, the fabric surface fastener of the invention can simultaneously meet the requirements i.e. securing high size stability and imparting softness to the base fabric, which are considered to be contradictory requirements in the conventional art.

Further, in the fabric surface fastener, preferably, the ground weft yarn may be made of core-sheath type thermal adhesive fibers. A weight ratio between a core component and a sheath component of the core-sheath type thermal adhesive fibers may be in the range of from 60:40 to 80:20. The thermal adhesive fibers may be a yarn having a dry heat shrinkage rate of 12% or more at 200° C.

Setting the weight ratio between a core component and a sheath component in the range of from 60:40 to 80:20 makes it possible to enhance the tearing strength of a tape when the weight ratio of a core component of the adhesive weft yarn is 60 or more. Further, since the weft yarn is appropriately adhered, enhanced texture is obtained. Further, setting the weight ratio to 80 or smaller makes it possible to enhance the pulling strength of engagement elements in a state that the adhesive strength is stable.

Further, the thermal adhesive fibers to be used as the ground weft yarn are fibers in which significant heat shrinkage occurs in a heat treatment condition. This makes it possible to thermally adhere the thermal adhesive fibers used as the ground weft yarn, and to fasten the roots of the hook-like engagement elements and the loop-like engagement elements from both sides thereof by shrinkage of the fibers. This is advantageous in firmly fixing the hook-like engagement elements and the loop-like engagement elements to the base fabric.

Further, in the fabric surface fastener, preferably, the multifilament yarn composing the loop-like engagement elements of the loop surface fastener (B) may be a multifilament yarn of 4 to 15 filaments and having a total decitex of 160 to 300 decitex.

In order to firmly fix the loop-like engagement elements to the base fabric by thermal adhesion, it is preferable to reduce the number of filaments composing the loop-like engagement elements in terms of infiltration of molten resin. Preferably, the number of filaments of the multifilament yarn for loop-like engagement elements constituting the invention may be slightly smaller than the number of filaments of a multifilament yarn composing loop-like engagement elements, which is conventionally and generally used.

Further, it is preferable to dye the back surface and the engagement element surface of the base fabric of each of the surface fasteners (A) and (B) with different color tones discriminatable from each other. This is advantageous in avoiding a sewing mistake.

EXAMPLES

In the following, the present invention is described by way of examples. The present invention, however, is not limited by these examples. In the examples, the dry heat shrinkage rate (filament shrinkage rate, B method) was measured in accordance with JIS-L-1013.

Example 1

As a ground warp yarn and a ground weft yarn composing a base fabric of a surface fastener, a monofilament yarn for hook-like engagement elements, and a multifilament yarn for loop-like engagement elements, the following yarns were prepared.

[Ground Warp Yarn]

- a multifilament yarn of polyethylene terephthalate having a melting point of 260° C.
- total decitex and the number of filaments: 167 dtex and 30 filaments

[Ground Weft Yarn (Thermal Adhesive Multifilament Yarn Consisting of Core-Sheath Type Composite Fibers)]

- core component: polyethylene terephthalate (melting point: 260° C.)
- sheath component: isophthalic acid 25 mol % polyethylene terephthalate copolymer (softening point: 180° C.)

core-sheath ratio (weight ratio): 70:30 total decitex and the number of filaments: 110 dtex and 24 filaments dry heat shrinkage rate at 200° C.: 18%

[Monofilament yarn for hook-like engagement elements]

polybutylene terephthalate fibers (melting point: 220° C.)

fineness: 330 dtex (diameter: 0.18 mm)

[Multifilament Yarn for Loop-Like Engagement Elements]

polybutylene terephthalate fibers (melting point: 220° C.)

total decitex and the number of filaments: 265 decitex and 7 filaments

A hook surface fastener (A) and a loop surface fastener (B) were manufactured in the following conditions with use of the aforementioned four types of yarns.

[Hook Surface Fastener (A)]

The hook surface fastener (A) was woven with use of the ground warp yarn, the ground weft yarn, and the monofilament yarn for hook-like engagement elements, with use of plain fabrics as a weaving structure, and with a weaving density (after heat shrinkage treatment) of 55 ground warp yarns/cm and 20 ground weft yarns/cm. A monofilament yarn for hook-like engagement elements was woven with respect to each four ground warp yarns in parallel to the ground warp yarns, and a loop was formed on the base fabric by allowing the monofilament yarn to cross over three consecutive ground warp yarns after floating over and sinking under three ground weft yarns so that the loop was formed at a position where the yarn crossed over the three consecutive ground warp yarns.

The tape for a hook surface fastener woven in the aforementioned condition was subjected to a heat treatment in a temperature condition, specifically, at 190° C. in which only a sheath component of the ground weft yarn was heat-melted, and the ground warp yarn, the monofilament yarn for hook-like engagement elements, and a core component of the ground weft yarn were not heat-melted. The ground weft yarn was shrunk, and the sheath component was melted so that the yarns in the vicinity of the sheath component were adhered. As a result, the base fabric was shrunk by 9% in the ground weft yarn direction. After the obtained fabric was cooled, leg portions of loops for hook-like engagement elements were cut, and hook-like engagement elements were formed.

The density of the hook-like engagement elements of the obtained hook surface fastener (A) was 60 elements/cm$^2$, and the height of the hook-like engagement elements from the surface of the base fabric was 1.6 mm.

[Loop Surface Fastener (B)]

The loop surface fastener (B) was woven with use of the ground warp yarn, the ground weft yarn, and the multifilament yarn for loop-like engagement elements, with use of plain fabrics as a weaving structure, and with a weaving density (after heat shrinkage treatment) of 55 ground warp yarns/cm and 22 ground weft yarns/cm. A multifilament yarn for loop-like engagement elements was woven with respect to each four ground warp yarns in parallel to the ground warp yarns without crossing over the ground warp yarns so that a loop was formed on the base fabric after the yarn floated over and sunk under five consecutive ground weft yarns.

The tape for a loop surface fastener woven in the aforementioned condition was subjected to a heat treatment at 190° C. in which only a sheath component of the ground weft yarn was heat-melted, and the ground warp yarn, the multifilament yarn for loop-like engagement elements, and a core component of the ground weft yarn were not heat-melted. The ground weft yarn was significantly shrunk, the sheath component was melted, and the yarns in the vicinity of the sheath component were adhered. As a result, the base fabric was shrunk by 12% in the ground weft yarn direction.

Subsequently, the obtained fabric was cooled. The density of the loop-like engagement elements of the obtained loop surface fastener (B) was 44 elements/cm$^2$, and the height of the loop-like engagement elements from the surface of the base fabric was 2.4 mm.

The hook surface fastener (A) and the loop surface fastener (B) were treated at 135° C. for 45 minutes in a high pressure condition in which PET fibers were dyeable, and dyed into navy blue by a disperse dye. As a result of the treatment, the hook surface fastener (A) and the loop surface fastener (B) could be dyed with a fine and deep navy blue color. Further, the hook surface fastener (A) and the loop surface fastener (B) were subjected to dye treatment at 130° C. for 30 minutes in the same manner as described above, taking into consideration a dyeing difference. As a result of the treatment, the engagement element portion could be dyed with a deep color, and the base fabric portion could be dyed with a light color. Thus, it was easy to discriminate the engagement element portion and the base fabric portion from each other when they were sewn as small pieces, and a sewing mistake was avoided.

The hook surface fastener (A) and the loop surface fastener (B) were immersed in water for 10 minutes, and taken out of the water. No change occurred with respect to the shape and the engaging strength. The base fabric was kept in a flat state.

Next, durability against engagement and peeling, durability against impact shear peeling, restorability regarding falling of engagement elements, texture (degree of hardness/softness), and tearing strength of the obtained surface fasteners were measured. The results of measurements are illustrated in Table 1.

The engaging strength was measured in accordance with JIS-L-3416. Durability against peeling was measured by performing hand peeling for 3,000 times. Impact shear peeling is a value obtained by attaching the hook surface fastener (A) and the loop surface fastener (B) sequentially at one end of a band with a D-ring, folding the hook surface fastener (A) and the loop surface fastener (B) at the middle portion thereof after passing the hook surface fastener (A) and the loop surface fastener (B) through the D-ring, engaging the hook surface fastener (A) and the loop surface fastener (B) by the area of 25 mm-width and 3 cm-length, mounting a 8-kg weight on the other end on a curved surface of 20 cm-diameter, vertically dropping the weight, and measuring a strength at which the hook surface fastener (A) and the loop surface fastener (B) were instantaneously peeled off from each other. Restorability regarding falling of engagement elements was measured in terms of a degree of falling of engagement elements after the engagement element surface was pressed and sewn by an industrial sewing machine. Texture was measured in accordance with JIS-L-1096 D method (heart loop method) in terms of a degree of hardness/softness. Tearing strength was measured in accordance with JIS-L-1096 A-1 method (single tongue method).

As is obvious from Table 1, regarding durability against engagement and peeling, the initial engaging strength was high, and even after engagement and peeling were repeated for 3,000 times, the engaging strength hardly lowered. Thus, it is clear that excellent durability was obtained. Further, regarding impact shear peeling, deformation of the hook-like engagement elements and the loop-like engagement elements was significantly less, and excellent impact shear peeling performance was obtained.

When restorability regarding falling of engagement elements was observed, the engagement elements on the portion that was pressed and sewn by the industrial sewing machine fell at the time of sewing. However, the engagement elements were sufficiently restored after the sewing operation. Regarding the degree of hardness/softness, the numerical value measured by the heart loop method indicated that the base fabric was significantly soft. The tearing strength was significantly high, and there was no worry about tearing from the sewn portion. Further, when the surface of the hook surface fastener was stroked by the hand, the hook surface fastener felt soft, and a soft touch was obtained.

Comparative Example 1

As a hook surface fastener (A), a hook surface fastener (A8693Y by Kuraray Fastening Co., Ltd.) in which a monofilament yarn for hook-like engagement elements was made of PET [melting point: 260° C., thickness: 390 decitex (diameter: 0.19 mm)], a ground warp yarn and a ground weft yarn composing a base fabric were polyester yarns, the ground weft yarn composing the base fabric was composed of core-sheath type thermal adhesive binder fibers, and the density of engagement elements was 40 elements/cm$^2$ was used. As a loop surface fastener (B), a loop surface fastener (B2790Y by Kuraray Fastening Co., Ltd.) in which a multifilament yarn for loop-like engagement elements was made of PET [melting point: 260° C., total decitex: 265 decitex, the number of filaments: 7 filaments], a ground warp yarn and a ground weft yarn composing a base fabric were polyester yarns, the ground weft yarn composing the base fabric was composed of core-sheath type thermal adhesive binder fibers, and the density of engagement elements was 40 elements/cm$^2$ was used. Combination of the hook surface fastener (A) and the loop surface fastener (B) was used. Durability against engagement and peeling, durability against impact shear peeling, restorability regarding falling of engagement elements, texture (degree of hardness/softness), and tearing strength were measured by the same measurement method as applied to the combination of the hook surface fastener and the loop surface fastener obtained in Example 1. The result of measurement is illustrated in Table 1. The hook surface fastener and the loop surface fastener, particularly, the hook surface fastener had a hard touch on the surface. The fastener had a rough touch at a portion which may directly come into contact with the skin.

Comparative Example 2

As a hook surface fastener (A), a hook surface fastener (A8493 by Kuraray Fastening Co., Ltd.) in which a monofilament yarn for hook-like engagement elements was made of PET [melting point: 260° C., thickness: 310 decitex (diameter: 0.17 mm)], a ground warp yarn and a ground weft yarn composing a base fabric were polyester yarns, the ground weft yarn composing the base fabric was composed of core-sheath type thermal adhesive binder fibers, and the density of engagement elements was 40 elements/cm$^2$ was used. As a loop surface fastener (B), the same loop surface fastener as used in Comparative Example 1 was used. Combination of the hook surface fastener (A) and the loop surface fastener (B) was used. Durability against engagement and peeling, durability against impact shear peeling, restorability regarding falling of engagement elements, texture (degree of hardness/softness), and tearing strength were measured by the same measurement method as applied to the combination of the hook surface fastener and the loop surface fastener obtained in Example 1. The results of measurements are illustrated in Table 1.

Combination of the hook surface fastener and the loop surface fastener, particularly, the hook surface fastener had a hard touch on the surface, as well as Comparative Example 1. The fastener had a rough touch at a portion which may directly come into contact with the skin.

As is obvious from the result of Table 1, Example 1 exhibited excellent results, as compared with Comparative Examples 1 and 2.

TABLE 1

| | | Ex 1 | C. Ex 1 | C. Ex 2 |
|---|---|---|---|---|
| engagement element composing resin | hook surface fastener (A) | PBT | PET | PET |
| | loop surface fastener (B) | PBT | PET | PET |
| initial engaging strength | shear strength (N/cm$^2$) | 10.5 | 10.5 | 10.2 |
| | peeling strength (N/cm) | 1.20 | 1.15 | 1.10 |
| engaging strength after 3,000-times hand peeling | shear strength (N/cm$^2$) | 7.0 | 5.0 | 5.6 |
| | peeling strength (N/cm) | 1.00 | 0.55 | 0.65 |
| impact shear peeling | initial (N/cm$^2$) | 29.0 | 34.5 | 24.0 |
| | after 50-times (N/cm$^2$) | 22.0 | 9.0 | 17.0 |
| restorability regarding falling | degree of falling after sewing by industrial sewing machine | no falling | fall | fall |
| degree of hardness/softness | heart loop method | 39 | 34 | 35 |
| tearing strength | | 2.0 | 1.5 | 1.5 |

Examples 2 and 3, and Comparative Examples 3 and 4

Combinations of hook surface fasteners and loop surface fasteners having the densities of hook-like engagement elements and the densities of loop-like engagement elements described in Table 2, in which the monofilament yarn for hook-like engagement elements, the number of loop-like engagement elements to be woven, and the number of yarns which cross over a ground weft yarn for forming a loop were changed with respect to Example 1 were manufactured. The surface fastener performances were measured in the same manner as Example 1. The results of measurements are illustrated in Table 2.

TABLE 2

| | | Ex 2 | Ex 3 | C. Ex 3 | C. Ex 4 |
|---|---|---|---|---|---|
| engagement element composing resin & | hook surface fastener | PBT | PBT | PBT | PBT |
| | | 70 | 55 | 40 | 90 |
| engagement element density (element/cm$^2$) | loop surface fastener | PBT | PBT | PBT | PBT |
| | | 49 | 35 | 60 | 25 |
| initial engaging strength | shear strength (N/cm$^2$) | 11.0 | 10.0 | 7.0 | hook |
| | peeling strength (N/cm) | 1.30 | 1.10 | 0.70 | weaving |

TABLE 2-continued

| | | Ex 2 | Ex 3 | C. Ex 3 | C. Ex 4 |
|---|---|---|---|---|---|
| engaging strength after 3,000-times hand peeling | shear strength (N/cm$^2$) | 8.0 | 7.0 | 5.5 | not possible |
| | peeling strength (N/cm) | 1.10 | 0.90 | 0.60 | |
| impact shear peeling | initial (N/cm$^2$) | 30.0 | 25.0 | 21.0 | |
| | after 50-times (N/cm$^2$) | 24.0 | 20.0 | 15.0 | |
| restorability regarding falling | degree of falling after sewing by industrial sewing machine | no falling | no falling | no falling | |
| degree of hardness/softness | heart loop method | 38 | 39 | 40 | |
| tearing strength | | 2.0 | 2.0 | 2.0 | |

As is obvious from the result of Table 2, it is clear that combinations of surface fasteners which meet the requirements on the density of hook-like engagement elements and the density of loop-like engagement elements defined in the invention exhibit excellent surface fastener performance. Further, the combination of surface fasteners of Examples 2 and 3 had a soft touch, and an excellent softness was obtained to such an extent that the fasteners could be satisfactorily used for direct contact with the human skin.

Example 4, and Comparative Examples 5 and 6

Hook surface fasteners were manufactured in the same manner as Example 1 except that the thickness of a PBT monofilament yarn for hook-like engagement elements was changed as illustrated in Table 3 with respect to Example 1. Engaging strengths of the hook surface fastener and the loop surface fastener were measured using the loop surface fastener manufactured in Example 1 as an engagement partner of the surface fastener. The result of measurement is illustrated in Table 3.

TABLE 3

| | | Ex 4 | C. Ex 5 | C. Ex 6 |
|---|---|---|---|---|
| hook-like engagement element composing resin & | | PBT | PBT | PBT |
| thickness (diameter: mm) | | 0.15 | 0.12 | 0.24 |
| initial engaging strength | shear strength (N/cm$^2$) | 8.0 | 5.0 | hook weaving |
| | peeling strength (N/cm) | 0.85 | 0.55 | |
| engaging strength after 3,000-times hand peeling | shear strength (N/cm$^2$) | 7.5 | 4.5 | not possible |
| | peeling strength (N/cm) | 0.75 | 0.45 | |

As is obvious from Table 3, it is clear that the fastener in which the thickness of the monofilament yarn composing a hook surface fastener is in the range defined in the invention exhibits excellent surface fastener performance.

Further, Example 4 had a significantly soft touch, and had a satisfactory softness when the fastener came into direct contact with the human skin.

Example 5

A surface fastener was manufactured in the same manner as Example 1 except that a sheath component of a ground weft yarn (a thermal adhesive multifilament yarn composed of core-sheath type composite fibers) was isophthalic acid 25 mol % polybutylene terephthalate copolymer (softening point: 180° C.) containing titanium oxide of 0.05% by weight, and that the dry heat shrinkage rate of the thermal adhesive yarn at 200° C. was 13.6%.

Durability against engagement and peeling, durability against impact shear peeling, restorability regarding falling of engagement elements, texture (degree of hardness/softness), and tearing strength of the surface fasteners were measured by the same measurement method as employed in Example 1. The result of measurement is illustrated in Table 4.

In Example 5 in which a sheath component of a ground weft yarn was isophthalic acid 25 mol % polybutylene terephthalate copolymer containing titanium oxide of 0.05% by weight as inorganic fine particles, excellent size stability was obtained, in addition to durability against engagement and peeling, durability against impact shear peeling, restorability regarding falling of engagement elements, degree of hardness/softness, tearing strength, and soft touch. Since size stability was excellent in terms of manufacturing and using, it is easy to manufacture the surface fastener. Further, in attaching the surface fastener to garments, it is easy to handle the surface fastener without forming wrinkles in the garments.

Examples 6 to 9

Hook surface fasteners (A) and loop surface fasteners (B) were manufactured by the same method as employed in Example 5 except that the amount of titanium oxide as inorganic fine particles to be added to a sheath component of thermal adhesive fibers composed of core-sheath type composite fibers to be used as a ground weft yarn was changed to 0% by weight (namely, bright fibers free of titanium oxide, Example 6), 0.03% by weight (Example 7), 0.8% by weight (Example 8), and 1.3% by weight (Comparative Example 9) with respect to Example 5.

The dry heat shrinkage rates of the thermal adhesive fibers were the same as the value of Example 5.

The hook surface fastener (A) and the loop surface fastener (B), whose added amounts of titanium oxide were the same were placed one over the other and engaged. Durability against engagement and peeling, durability against impact shear peeling, restorability regarding falling of engagement elements, texture (degree of hardness/softness), and tearing strength were measured by the same measurement method as employed in Example 1.

The result of measurement is illustrated in Table 4. Regarding the touch of the hook surface fasteners and the loop surface fasteners, the touch was not so different from the touch of Example 5, and was satisfactory. However, regarding the degree of hardness/softness of the base fabric, Example 6 was slightly poor. Further, although Example 9 had a satisfactory degree of hardness/softness of the base fabric, durability against engagement and peeling of Example 9 was slightly poor, as compared with Examples 7 and 8.

TABLE 4

| | | Ex 5 | Ex 6 | Ex 7 | Ex 8 | Ex 9 |
|---|---|---|---|---|---|---|
| engagement element composing resin | hook surface fastener (A) | PBT | PBT | PBT | PBT | PBT |
| | loop surface fastener (B) | PBT | PBT | PBT | PBT | PBT |
| sheath component of core-sheath type fibers | added amount of titanium oxide (wt. %) | 0.05 | 0 | 0.03 | 0.8 | 1.3 |
| initial engaging strength | shear strength (N/cm$^2$) | 11.0 | 10.5 | 10.5 | 10.5 | 10.0 |
| | peeling strength (N/cm) | 1.30 | 1.20 | 1.25 | 1.30 | 1.35 |
| engaging strength after 3,000-times hand peeling | shear strength (N/cm$^2$) | 7.5 | 7.0 | 7.0 | 7.0 | 5.5 |
| | peeling strength (N/cm) | 1.10 | 1.00 | 1.10 | 1.15 | 0.8 |
| impact shear peeling | initial (N/cm$^2$) | 29.5 | 29.0 | 29.0 | 29.0 | 27.0 |
| | after 50-times (N/cm$^2$) | 24.0 | 22.0 | 23.0 | 24.0 | 18.0 |
| restorability regarding falling | degree of falling after sewing by industrial sewing machine | no falling | no falling | no falling | no falling | no falling |
| degree of hardness/softness (heart loop method) | hook surface fastener (A) | 42 | 39 | 42 | 43 | 43 |
| | loop surface fastener (B) | 46 | 43 | 46 | 47 | 47 |
| tearing strength | kg | 2.5 | 2.0 | 2.5 | 2.5 | 2.5 |

Comparative Example 7

A hook surface fastener (A) and a loop surface fastener (B) were manufactured in the same manner as Example 5 except that a multifilament yarn made of PBT (167 decitex, 30 filaments) was used as a ground warp yarn. The fasteners were loosened during the manufacturing process, and were difficult to be manufactured as compared with Example 5. Further, when the obtained surface fasteners were sewn to a chest portion of garments by using a high-speed sewing machine, a part of the sewn product was distorted by a tensile strength exerted at the time of sewing, and wrinkles were formed in some of the products by distortion.

Comparative Example 8

As a hook surface fastener (A), a hook surface fastener in which a monofilament yarn for hook-like engagement elements was made of PET [melting point: 260° C., thickness: 310 decitex (diameter: 0.17 mm)], a ground warp yarn and a ground well yarn composing a base fabric were PET polyester yarns, the sheath component of the ground weft yarn was composed of core-sheath type thermal adhesive binder fibers made of isophthalic acid PET copolymer, and the density of engagement elements was 40 elements/cm$^2$ was used. As a loop surface fastener (B), a loop surface fastener in which a multifilament yarn for loop-like engagement elements was made of PET [melting point: 260° C., total decitex: 265 decitex, the number of filaments: 7 filaments], a ground weft yarn composing a base fabric was made of isophthalic acid PET copolymer, the core component was composed of thermal adhesive binder fibers of PET, and the density of engagement elements was 40 elements/cm$^2$ was used. Combination of the hook surface fastener (A) and the loop surface fastener (B) was used, and measurement was performed in the same manner as applied to the combination of the hook surface fastener and the loop surface fastener obtained in Example 1. Durability against engagement and peeling, durability against impact shear peeling, restorability regarding falling of engagement elements, texture (degree of hardness/softness), and tearing strength were measured. The result of measurement is illustrated in Table 5.

The fabric surface fastener consisting of the hook surface fastener and the loop surface fastener, particularly, the hook surface fastener had a hard touch on the surface. The fastener had a rough touch at a portion which may directly come into contact with the skin.

Examples 10 and 11, and Comparative Example 9

Hook surface fasteners (A) and loop surface fasteners (B) having the densities of hook-like engagement elements and the densities of loop-like engagement elements as described in Table 5 were manufactured except that a monofilament yarn for hook-like engagement elements, the number of loop-like engagement elements to be woven, and the number of yarns which cross over a ground weft yarn for forming a loop were changed with respect to Example 5. The performances of the surface fasteners were measured in the same manner as Example 1. The result of measurement is illustrated in Table 5.

As is obvious from the result of Table 5, it is clear that a surface fastener which meets the requirements on the density of hook-like engagement elements and the density of loop-like engagement elements defined in the invention exhibits excellent surface fastener performance. Further, it is clear that the surface fasteners of Examples 10 and 11 had a soft touch, and are appropriate for use in direct contact with the human skin. Further, the surface fasteners had a soft touch, and were excellent when sewn to garments. On the other hand, there is an example, in which the density of engagement elements is deviated from the range of the invention. It is clear that Comparative Example 9 had a considerably low engaging strength.

TABLE 5

| | | C. Ex 8 | Ex 10 | Ex 11 | C. Ex 9 | C. Ex 10 |
|---|---|---|---|---|---|---|
| engagement element composing resin & engagement element density | hook surface fastener (A) (element/cm$^2$) | PET 40 | PBT 70 | PBT 55 | PBT 40 | PBT (diameter: 0.11) 60 |
| | loop surface fastener (B) (element/cm$^2$) | PET 40 | PBT 50 | PBT 35 | PBT 60 | PBT 44 |
| sheath component of core-sheath type fibers | added amount of titanium oxide (wt. %) | 0.05 | 0.05 | 0.05 | 0.05 | 0.05 |
| initial engaging strength | shear strength (N/cm$^2$) | 10.2 | 11.0 | 10.0 | 8.0 | 5.5 |
| | peeling strength (N/cm) | 1.10 | 1.35 | 1.15 | 0.80 | 0.60 |
| engaging strength after 3,000-times hand peeling | shear strength (N/cm$^2$) | 5.6 | 8.0 | 7.0 | 6.0 | 3.5 |
| | peeling strength (N/cm) | 0.55 | 1.15 | 1.00 | 0.70 | 0.40 |
| impact shear peeling | initial (N/cm$^2$) | 24.0 | 30.0 | 25.0 | 21.0 | — |
| | after 50-times (N/cm$^2$) | 17.0 | 24.0 | 21.0 | 15.0 | — |
| restorability regarding falling | degree of falling after sewing by industrial sewing machine | fall | no falling | no falling | no falling | — |
| degree of hardness/softness (heart loop method) | hook surface fastener (A) | 34 | 42 | 42 | 42 | — |
| | loop surface fastener (B) | 35 | 46 | 46 | 47 | — |
| tearing strength | Kg | 1.5 | 2.5 | 2.5 | 2.5 | — |

Example 12

A hook surface fastener (A) and a loop surface fastener (B) were respectively manufactured by the same method as Example 5 except that 0.05% by weight of silicon dioxide was added as inorganic fine particles to be added to a sheath component of thermal adhesive fibers composed of core-sheath type composite fibers to be used as a ground weft yarn in Example 5. The performances of the obtained surface fasteners were substantially the same as Example 5.

Comparative Example 10

A hook surface fastener was manufactured in the same manner as Example 5 except that a monofilament PET yarn of 0.11 mm in diameter was used as a monofilament yarn for hook-like engagement elements in Example 5.

Comparative Example 11

Further, as well as Comparative Example 10, a hook surface fastener was manufactured in the same manner as Example 5 except that a monofilament PET yarn of 0.22 mm in diameter was used as a monofilament yarn for hook-like engagement elements.

In the hook surface fastener of Comparative Example 10, regarding the initial engaging strength with respect to the loop surface fastener of Example 5, a shear strength was 5.5 N/cm$^2$ and a peeling strength was 0.60 N/cm, and regarding the engaging strength after 3,000-times hand peeling, a shear strength was 3.5 N/cm$^2$ and a peeling strength was 0.40 N/cm. Thus, the hook surface fastener of Comparative Example 10 had a considerably low engaging strength.

Further, the hook surface fastener of Comparative Example 11 was too thick to be woven into a fabric. This was a large obstacle in manufacturing. The manufactured hook surface fastener had a hard touch due to a hard PBT monofilament yarn on the surface of the fastener. Further, the base fabric was also hard, and was hardly usable for garments.

The present application is based on Japanese Patent Application No. 2013-175361 filed on Aug. 27, 2013, the contents of which are hereby incorporated by reference.

Although the present invention has been appropriately and fully described by way of the embodiments, it is to be understood that various changes and/or modifications of the embodiments will be apparent to those skilled in the art. Therefore, unless otherwise such changes or modifications to be carried out by those skilled in the art depart from the scope of the present invention hereinafter defined, they should be construed as being included therein.

INDUSTRIAL APPLICABILITY

The present invention has a wide industrial applicability in the technical field pertaining to a loop surface fastener, a hook surface fastener, a surface fastener consisting of the loop surface fastener and the hook surface fastener, and a method for manufacturing the loop surface fastener, the hook surface fastener, and the surface fastener.

The invention claimed is:

1. A fabric surface fastener consisting of a hook surface fastener including hook-like engagement elements made of a monofilament yarn on a surface of a base fabric, and a loop surface fastener including loop-like engagement elements made of a multifilament yarn on a surface of a base fabric, the loop-like engagement elements being engageable with the hook-like engagement elements, wherein the monofilament yarn is a monofilament yarn made of polybutylene terephthalate polyester resin and having a diameter of from 0.14 to 0.20 mm, the multifilament yarn is a multifilament yarn made of polybutylene terephthalate polyester resin, a density of the hook-like engagement elements is from 50 to 80 elements/cm$^2$, and a density of the loop-like engagement elements is from 30 to 50 elements/$cm^2$, the density of the hook-like engagement elements being higher than the density of the loop-like engagement elements, and a ground warp yarn composing the base fabrics is a multifilament yarn made of polyethylene terephthalate polyester.

2. The fabric surface fastener according to claim 1, wherein a ground warp yarn and a ground weft yarn composing the base fabric of the hook surface fastener and the base fabric of the loop surface fastener are yarns made of polyester resin, the ground weft yarn includes core-sheath type thermal adhesive fibers, and the hook-like engagement elements and the loop-like engagement elements are adhesively fixed by the ground weft yarn composing the base fabric.

3. The fabric surface fastener according to claim 2, wherein a sheath component of the thermal adhesive fibers contains fine particles of 0.03 to 1% by weight with respect to sheath component composing resin.

4. The fabric surface fastener according to claim 3, wherein the fine particles are inorganic fine particles.

5. The fabric surface fastener according claim 2, wherein a weight ratio between a core component and a sheath component of the core-sheath type thermal adhesive fibers is in the range of from 60:40 to 80:20, and the thermal adhesive fibers has a dry heat shrinkage rate of 12% or more at 200° C.

6. The fabric surface fastener according to claim 2, wherein the core-sheath type thermal adhesive fibers contained in the ground weft yarn are a multifilament yarn consisting of core-sheath type thermal adhesive filaments in which a sheath component is low melting point polyester of polyethylene terephthalate or polybutylene terephthalate.

7. The fabric surface fastener according to claim 6, wherein the low melting point polyester is polybutylene terephthalate polyester.

8. The fabric surface fastener according to claim 1, wherein the multifilament yarn composing the loop-like engagement elements of the loop surface fastener is a multifilament yarn of 4 to 15 filaments and having a total decitex of 160 to 300 decitex.

9. The fabric surface fastener according to claim 1, wherein a back surface and an engagement element surface of the base fabric of each of the hook surface fastener and the loop surface fastener are dyed with different color tones discriminatable from each other.

* * * * *